US007974555B2

(12) United States Patent
Okazaki et al.

(10) Patent No.: US 7,974,555 B2
(45) Date of Patent: Jul. 5, 2011

(54) DEVELOPMENT APPARATUS AND IMAGE FORMING APPARATUS

(75) Inventors: Futoshi Okazaki, Toyokawa (JP); Kazuhiro Sakamoto, Hoi-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/486,092

(22) Filed: Jun. 17, 2009

(65) Prior Publication Data

US 2009/0317141 A1 Dec. 24, 2009

(30) Foreign Application Priority Data

Jun. 19, 2008 (JP) ..... 2008-160471

(51) Int. Cl.
*G03G 15/08* (2006.01)

(52) U.S. Cl. ..... 399/254; 399/257

(58) Field of Classification Search ..... 399/254, 399/256, 257; 222/DIG. 1
See application file for complete search history.

(56) References Cited

U.S. PATENT DOCUMENTS 7,376,374 B2 5/2008 Adachi
7,593,671 B2 * 9/2009 Ishikawa et al. ..... 399/254
2009/0214232 A1 * 8/2009 Murauchi et al. ..... 399/254 X
2009/0257761 A1 * 10/2009 Kato et al. ..... 399/254 X
2009/0310985 A1 * 12/2009 Hirata et al. ..... 399/254 X

FOREIGN PATENT DOCUMENTS

| | | |
|---|---|---|
| JP | 05-289500 | 11/1993 |
| JP | 2006-208577 | 8/2006 |
| JP | 2006-323238 A | 11/2006 |
| JP | 2007-072329 | 3/2007 |
| JP | 2007-148053 | 6/2007 |

OTHER PUBLICATIONS

Notification of Reasons for Rejection issued in the corresponding Japanese Patent Application No. 2008-160471 dated Apr. 20, 2010, and an English Translation thereof.

* cited by examiner

*Primary Examiner* — Sophia S Chen
(74) *Attorney, Agent, or Firm* — Buchanan Ingersoll & Rooney PC

(57) ABSTRACT

A development apparatus 8 has developer transport members 26 and 27 respectively contained in containers 22 and 23 and transporting developer while stirring the developer and passing the developer to each other at a passing portion 41 and a passing portion 42, thereby causing the developer to circulate in a developer tank 21. The passing portion 41 is formed at a location of a partition 21*c* adjacent to a developer discharging mechanism 34 and the passing portion 42 is formed at a location of the partition 21*c* away from the developer discharging mechanism 34. The passing portions 41 and 42 have configurations in which a transport force acting on the developer at the passing portion 41 is greater than the transport force acting on the developer at the passing portion 42.

8 Claims, 9 Drawing Sheets

DEVELOPMENT APPARATUS AND IMAGE FORMING APPARATUS

RELATED APPLICATION

This application is based on Japanese Patent Application No. 2008-160471, the contents of which are incorporated herein by reference.

BACKGROUND OF THE INVENTION

The present invention relates to a development apparatus in image forming apparatuses of an electrophotographic system, including copiers, printers, facsimile machines, and multifunction products thereof.

In a processing apparatus, such as a development apparatus, included in an image forming apparatus of an electrophotographic system, particularly with an increase in full-color output, there are demands for an extension of life, an increase in reliability, and an improvement in image quality in addition to miniaturization of the apparatus and an increase in output.

In the development apparatus, a so-called two-component development system in which developer having toner and carrier mixed therein is used is the mainstream. In the two-component development system, by continuously replenishing toner, images can be outputted for a long period of time. However, in a conventional two-component development system in which an amount of toner corresponding to an amount of toner consumed by development is replenished without discharging any developer from a development apparatus, degradation of carrier that develops with time is problematic.

Hence, in recent years, in terms of mainly an extension of life and an increase in reliability, a so-called trickle system has attracted attention in which by replenishing not only toner but also carrier in a development apparatus at an appropriate probability and discharging unnecessary carrier, carrier in the development apparatus is changed at a certain probability, whereby degradation of carrier is suppressed. In the trickle system, by adding carrier at a certain ratio to toner to be replenished and replenishing the carrier and the toner all together, the amount of developer in a developer apparatus is maintained at a certain level. Since a portion of developer that exceeds the certain level is discharged outside the development apparatus by a developer discharging mechanism, developer in the development apparatus is changed at a certain probability within a certain period of time. New carrier is continuously replenished, which in turn suppresses degradation of developer.

However, the so-called trickle system has another problem that does not arise in the conventional two-component development system. The problem will be described in detail below. In the conventional two-component development system, since the replenishing and discharging of carrier are not performed, the amount of developer in a development apparatus is always constant. For example, even when tilting of a development apparatus, variation in the fluidity of developer itself, or variation in the operating speed of a development apparatus occurs, since a development apparatus of the conventional two-component development system is, so to speak, a closed system, the amount of developer is maintained constant. However, in the trickle system, since, as described above, the refilling and discharging of carrier are performed, an increase or decrease in the amount of developer in a development apparatus may occur depending on the condition. In a developer discharging mechanism, a discharge force and a blocking force that restricts discharge act on developer. When tilting of the development apparatus, variation in the fluidity of developer itself, variation in the operating speed of the development apparatus, or the like, occurs, a discharge force and a blocking force against developer in the developer discharging mechanism vary. Due to the variation, an increase or decrease in the amount of developer in the development apparatus occurs. This indicates that developer circulation in the development apparatus that is balanced in the conventional two-component development system as a closed system can be disturbed in the trickle system by the influence of the developer discharging mechanism.

Particularly near the developer discharging mechanism, the influence of a discharge force that attempts to discharge developer and a blocking force that attempts to restrict the discharge force is remarkable. Accordingly, the circulation performance of developer near the developer discharging mechanism needs to be set taking into account these discharge force and blocking force, relative to circulation performance on the side where the developer discharging mechanism is not present. Specifically, near the developer discharging mechanism, due to the influence of these discharge force and blocking force, circulation performance is weakened as compared with that on the other side of the developer discharging mechanism. Accordingly, circulation performance sensitively reacts to the aforementioned tilting, variation in fluidity, variation in speed, or the like.

Hence, when the influence of a discharge force and a blocking force in the developer discharging mechanism is not taken into consideration, if the development apparatus is tilted, then depending on the up/down position of the developer discharging mechanism, discharging of developer may be promoted more or may be inhibited more over the case in which the development apparatus is in a normal position, which causes variation in the amount of developer in the development apparatus. Also, a change in circulation performance brought about by a change in the speed of the development apparatus leads to a change in the developer discharge performance of the developer discharging mechanism, which similarly causes variation in the amount of developer in the development apparatus.

A decrease in the amount of developer in the development apparatus leads to a decrease in the amount of developer supplied to a developer carrying member, which in turn causes problems such as image loss and a developer supply failure. On the other hand, an increase in the amount of developer in the developer apparatus causes stagnation of circulation of the developer in the development apparatus, which in turn causes problems such as insufficient stirring of developer and a developer supply failure.

Japanese Patent Application L,aid-open Publication No. 2006-323238 discloses a configuration in which, in a circulation transport system using spiral blades, the blades are partially eliminated near a developer discharging mechanism, a configuration in which the blades are allowed to partially have a double-threaded structure near the developer discharging mechanism, and a configuration in which a spiral blade oriented in an opposite direction is partially provided near the developer discharging mechanism. These configurations are intended to make the amount of developer in a development apparatus constant by suppressing the accumulation height of developer near the developer discharging mechanism and thereby making the amount of developer introduced into the developer discharging mechanism constant.

The configurations disclosed in Japanese Patent Application Laid-open Publication No. 2006-323238, however, have the following problems.

In the configuration in which the blades are partially eliminated and the configuration in which the blades are allowed to partially have a double-threaded structure, since a developer transport force near the developer discharging mechanism is reduced, developer present in this portion does not move or becomes difficult to move and as a result stays in the development apparatus for a long period of time. This is a phenomenon conflicting with the original purpose of the trickle system, that is, the prevention of degradation of carrier by changing developer.

In the configuration in which a blade oriented in an opposite direction is partially provided, since a developer transport force locally increases and thus a difference in transport speed occurs between the downstream side and the upstream side, retention of developer occurs and accordingly the amount of developer in the development apparatus is not stabilized.

Furthermore, when the rotational speed of the spiral blades is changed, a difference in energy between before and after the change is proportional to the square of the speed. Therefore, when the configurations of the spiral blades are partially changed, as in the configurations disclosed in Patent Document 1, variation in the amount of developer in the development apparatus caused by the change in rotational speed increases.

SUMMARY OF THE INVENTION

An object of the present invention is to achieve stable development performance in a development apparatus of a trickle system in an image forming apparatus of an electrophotographic system, by stabilizing the circulation performance of developer in the development apparatus, with a simple configuration and thereby stabilizing the amount of developer in the development apparatus to a certain level.

According to a first aspect of the present invention, there is provided A development apparatus comprising: a developer tank that has first and second containers separated by a partition so as to be adjacent to each other and respectively containing developer including toner and carrier; a developer carrying member that carries the developer contained in the developer tank and allows the developer to be adhered onto an image carrying member; a developer discharging mechanism that discharges a part of the developer contained in the developer tank; a developer replenishing portion formed in the developer tank and replenishing an amount of developer that is proportional to an amount of the developer discharged by the developer discharging mechanism to the developer tank; and a first and a second developer transport members that are respectively contained in the first and the second containers and that transport the developer while stirring the developer and pass the developer to each other at a first passing portion and a second passing portion and thereby cause the developer to circulate in the developer tank, the first passing portion being formed at a location of the partition adjacent to the developer discharging mechanism and the second passing portion being formed at a location of the partition away from the developer discharging mechanism, wherein the first and the second passing portions have configurations in which a transport force acting on the developer at the first passing portion is greater than the transport force acting on the developer at the second passing portion.

The development apparatus according to the first aspect is of a trickle system in which developer is caused to circulate in the developer tank by the first and second developer transport members, a part of the developer is discharged by the developer discharging mechanism, and developer is replenished from the developer replenishing portion. In the developer discharging mechanism, a force that discharges developer and a force that restricts the discharge of developer are present. However, by making a transport force acting on developer at the first passing portion adjacent to the developer discharging mechanism greater than a transport force acting on developer acting on developer at the second passing portion provided away from the developer discharging mechanism, the influence exerted on a developer transport force by the force that discharges developer and the force that restricts the discharge of developer which are present in the developer discharging mechanism can be eliminated or reduced. As a result, the circulation performance of developer in the development apparatus is stabilized, enabling to stabilize the amount of developer in the development apparatus to a certain level.

Specifically, a height of a lower end of the first passing portion is lower than the height of a lower end of the second passing portion.

As an alternative, a width of the first passing portion is narrower than the width of the second passing portion.

According to a second aspect of the present invention, there is provided an image forming apparatus including a development apparatus according to the first aspect.

According to the development apparatus of the present invention, the circulation performance of developer in the development apparatus is stabilized, enabling to stabilize the amount of developer in the development apparatus to a certain level. By suppressing an increase and decrease in the amount of developer in the development apparatus, image loss or an insufficient supply of toner due to an insufficient amount of developer, or a local image overlap or an insufficient toner density resulting from a developer circulation failure due to an excess of developer can be eliminated or suppressed, enabling to achieve stable development performance.

BRIEF DESCRIPTION OF THE DRAWINGS

These and other objects and features of the invention will become apparent from the following description taken in conjunction with preferred embodiments of the invention with reference to the accompanying drawings, in which.

DETAILED DESCRIPTION OF THE PREFERRED EMBODIMENTS

A first embodiment of the present invention will be described in detail with reference to the accompanying drawings.

First Embodiment

Figure 1:
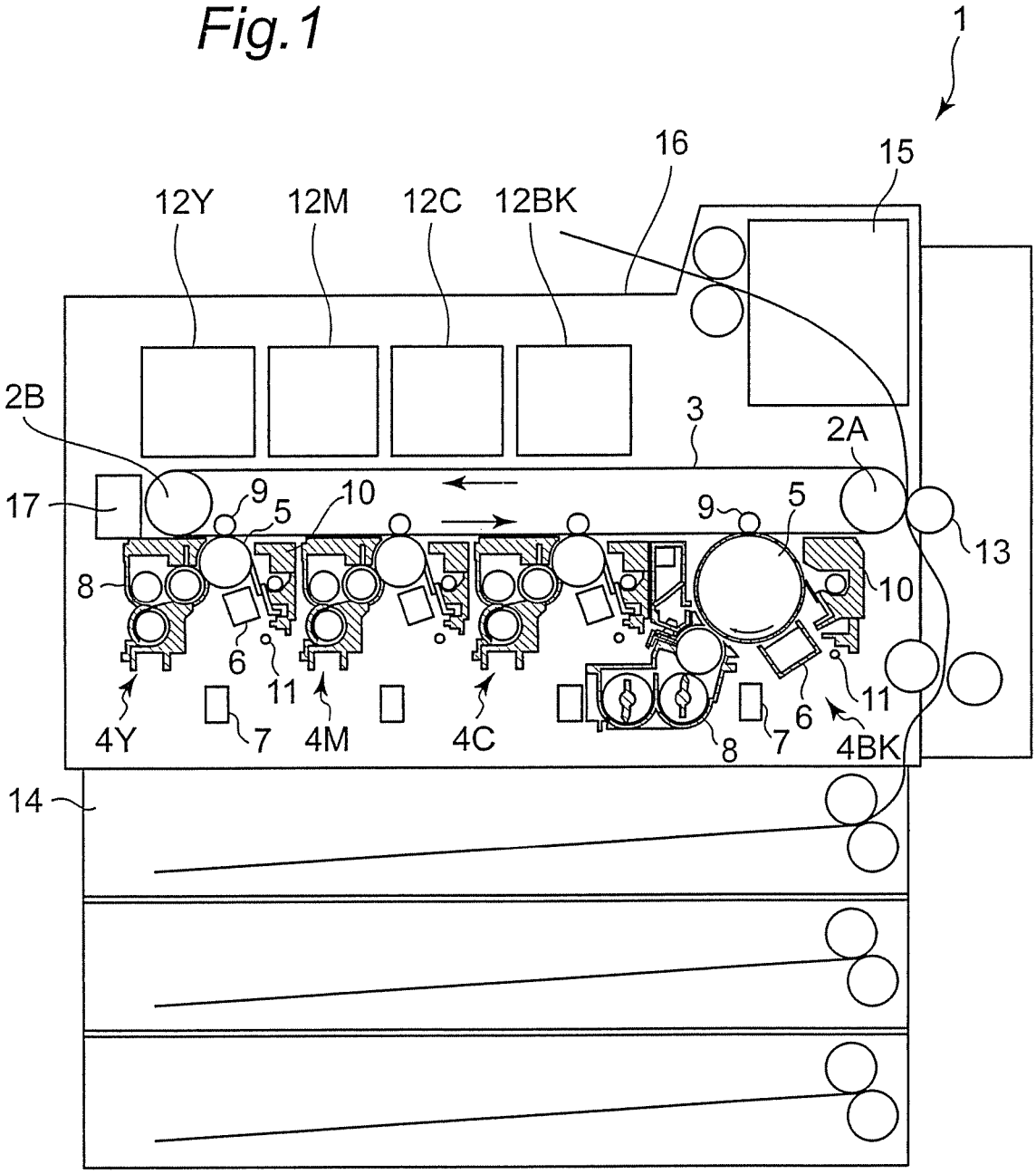
FIG. 1 is a schematic cross-sectional view showing an image forming apparatus including a development apparatus according to a first embodiment of the present invention.

FIG. 1 is a diagram showing a tandem-type color image forming apparatus 1 to which electrophotographic technology is applied, according to the present embodiment. Note, however, that the application of the present invention is not limited to the image forming apparatus 1 of this type; for example, the present invention can also be applied to color image forming apparatuses and monochrome output image forming apparatuses of a so-called four cycle system. Also, the present invention can be applied to copiers, printers, and facsimile machines and multifunction products having functions thereof in combination.

The image forming apparatus 1 includes an intermediate transfer belt 3 that is wound around a pair of rollers 2A and 2B and rotatedly driven counterclockwise in the drawing.

Under a lower horizontal portion of the intermediate transfer belt 3, four image forming units 4Y, 4M, 4C, and 4BK respectively corresponding to yellow (Y), magenta (M), cyan (C), and black (BK) colors are disposed side by side. Each of the image forming units 4Y to 4BK includes a photosensitive drum 5 and a charging apparatus 6, an exposure apparatus 7, a development apparatus 8, a primary transfer roller 9, a cleaning apparatus 10, and a static eliminating apparatus 11 which are disposed around the photosensitive drum 5. Furthermore, above the intermediate transfer belt 3, hoppers 12Y, 12M, 12C, and 12BK that detachably place toner bottles (not shown) of corresponding colors are disposed.

In each of the image forming units 4Y to 4BK, on a surface of the photosensitive drum 5 that is uniformly charged by the charging apparatus 6 after static elimination by the static eliminating apparatus 11, an electrostatic latent image is formed by irradiation of laser light from the exposure apparatus 7. By toner supplied from the development apparatus 8, the electrostatic latent image on the photosensitive drum 5 is visualized into a toner image. Toner images on the respective photosensitive drums 5 of the image forming units 4Y to 4BK are transferred onto the intermediate transfer belt 3 in a superimposing manner by the corresponding primary transfer rollers 9. Toner remaining on the photosensitive drums 5 is removed by the corresponding cleaning apparatuses 10. The toner images on the intermediate transfer belt 3 are transferred onto a recording medium that is supplied from a paper feed cassette 14 by secondary transfer rollers 13. The recording medium is subjected to toner image fusing by heating and pressurization by a fusing apparatus 15 and is thereafter ejected to a paper output portion 16. Toner images that remain on the intermediate transfer belt 3 even after the transfer are removed by a cleaning apparatus 17.

Although in the present embodiment the present invention is applied to the development apparatus 8 included in the black (BK) image forming unit 4BK, needless to say, the present invention can be applied to the development apparatuses 8 of the respective other imaging forming units 4Y to 4C.

The development apparatus 8 of the image forming unit 4BK shown in FIGS. 2 to 4D will be described in detail below.

Figure 2:
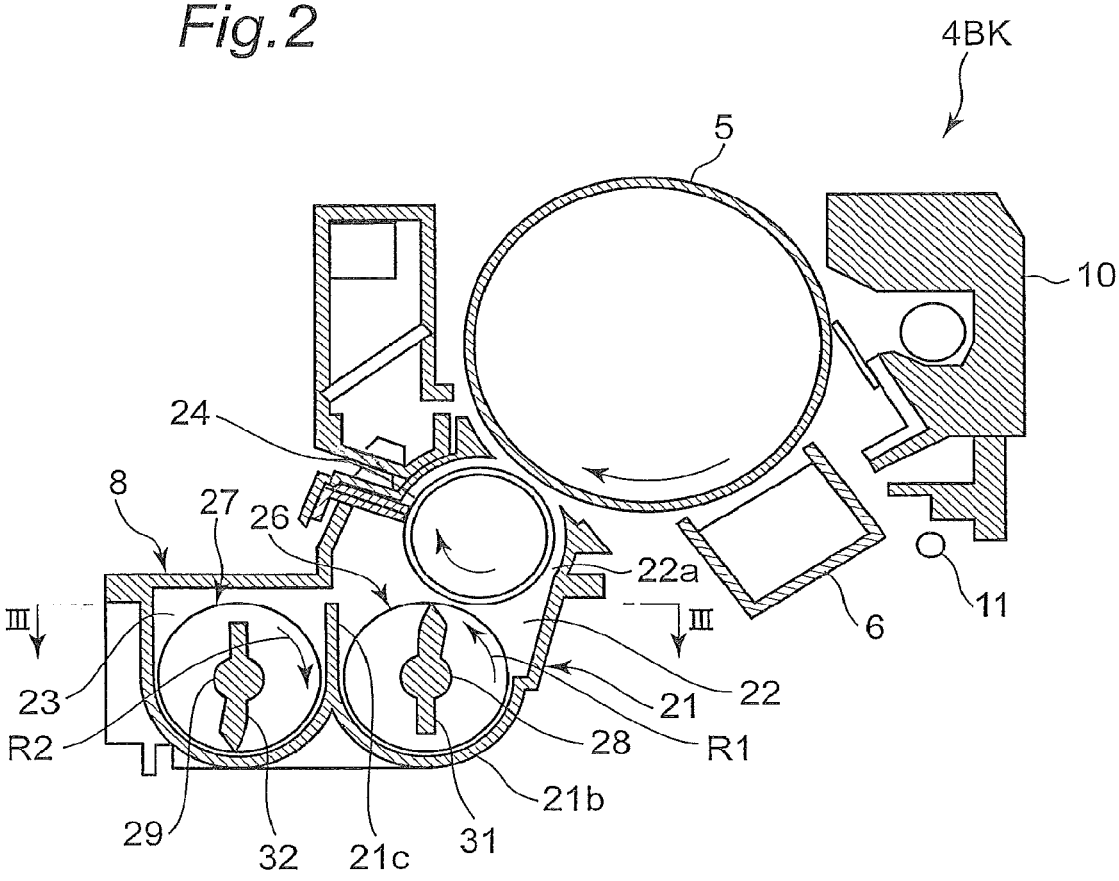
FIG. 2 is a schematic cross-sectional view showing the development apparatus according to the first embodiment of the present invention.

With reference to FIG. 2, the development apparatus 8 is of a trickle system. Specifically, developer that circulates in the development apparatus 8 is discharged from the development apparatus 8 by a developer discharging mechanism 34 which will be described later, and such an amount of developer that is proportional to an amount of developer discharged by the developer discharging mechanism 34 is replenished in the development apparatus 8 from the hopper 12BK (see FIG. 1) through a developer replenishing portion 37 which will be described later. The developer is two-component developer containing toner and carrier and may further contain an external additive, etc. The toner is charged by contact (friction) with the carrier during circulation in the development apparatus 8.

The development apparatus 8 includes a developer tank 21 where developer is contained and circulates. In the present embodiment, the developer tank 21 has an elongated box shape. The inside of the developer tank 21 is divided into two parts along a longitudinal direction by a partition 21*c* that protrudes upward from a bottom 21*b* and is thereby partitioned into two containers 22 and 23 which are both elongated space and are adjacent to each other.

As shown only in FIG. 2, a development roller (developer carrying member) 24 is disposed to face an opening 22*a* above the container 22. By a magnet (not shown) in the development roller 24 a part of developer in the container 22 is sucked and adhered onto the development roller 24, and by a magnetic field by an electrostatic latent image on the photosensitive drum 5 toner is adhered onto the photosensitive drum 5.

The containers 22 and 23 respectively contain developer transport members 26 and 27. The developer transport members 26 and 27 respectively include straight columnar rotating shafts 28 and 29; and spiral blades 31 and 32 formed on outer surfaces of the rotating shafts 28 and 29. In the present embodiment, the rotating shafts 28 and 29 of the developer transport members 26 and 27 extend in parallel to each other and the configurations (a radius, and a pitch) of the spiral blades 31 and 32 of the developer transport members 26 and 27 are the same throughout the length direction of the rotating shafts 28 and 29. The spiral blades 31 and 32 of the two developer transport members 26 and 27 have the same configuration. The rotating shafts 28 and 29 of the developer transport members 26 and 27 are rotatedly driven in directions shown by arrows R1 and R2 by a drive mechanism which is not shown.

Figure 3:
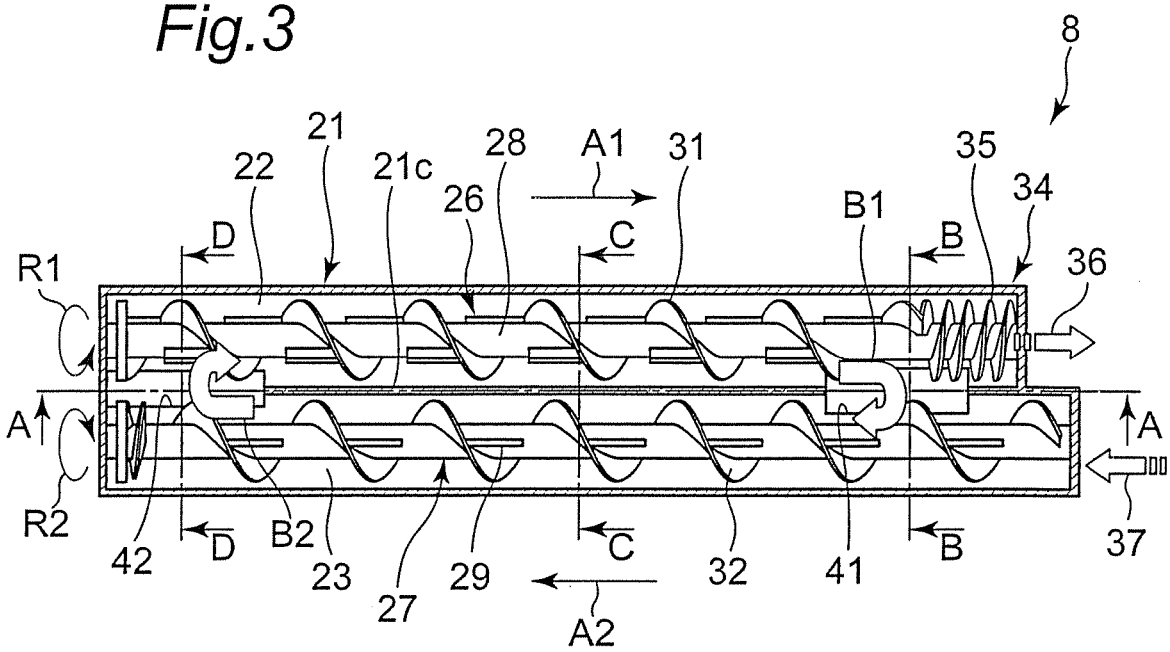
FIG. 3 is a cross-sectional view taken along line III-III of FIG. 2.

In the container 22, by rotation of the developer transport member 26, as shown by an arrow A2 in FIG. 3, developer is transported from one end (left side in FIG. 3) to the other end (right side in FIG. 3) of the developer transport member 26 while being stirred. In the container 23, by rotation of the developer transport member 27, as shown by an arrow A2 in FIG. 3, developer is transported from one end (right side in FIG. 3) to the other end (left side in FIG. 3) of the developer transport member 27 while being stirred.

As shown in FIG. 3, in the container 22, a developer discharging mechanism 34 for discharging unnecessary developer is provided on the downstream side (right side in FIG. 3) in a developer transport direction of the developer transport member 26. In the present embodiment, the developer discharging mechanism 34 includes a spiral blade 35 oriented in an opposite direction to the direction of the spiral blade 31 provided on the rotating shaft 28 of the developer transport member 26; and a developer discharge outlet formed in the developer tank 21 and schematically shown by reference numeral 36. That is, in the present embodiment, the developer discharging mechanism 34 is provided coaxially with respect to the developer transport member 26. Unnecessary developer discharged from the developer tank 21 through the developer discharge outlet 36 is collected in a collection box which is not shown.

As shown in FIG. 3, in the container 23, a developer replenishing portion which is schematically shown by reference numeral number 37 is provided on the upstream side (right side in FIG. 3) in a developer transport direction of the developer transport member 27. New developer from the hopper 12BK is replenished in the developer tank 21 through the developer replenishing portion 37.

Figure 4A:
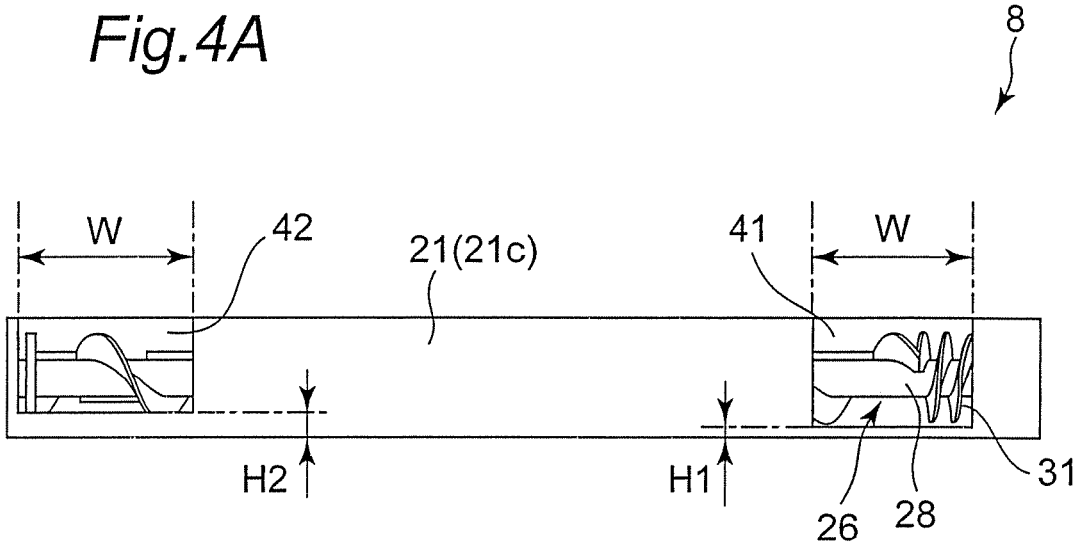
FIG. 4A is a cross-sectional view taken along line A-A of FIG. 3.
Figure 4B:
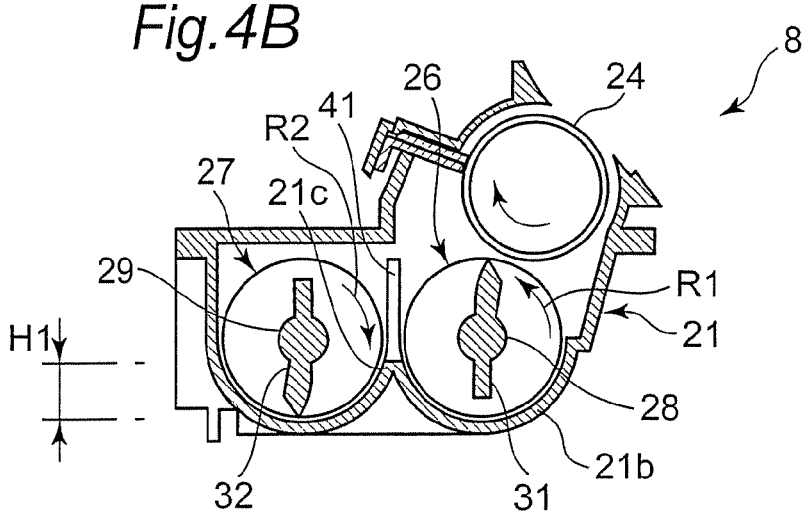
FIG. 4B is a cross-sectional view taken along line B-B of FIG. 3.

As shown in FIGS. 3, 4A, and 4B, to pass developer (an arrow B1) between a portion on the downstream side in the developer transport direction A1 of the developer transport member 26 and a portion on the upstream side in the developer transport direction A2 of the developer transport member 27, a portion of the partition 21*c* corresponding to these portions (near a right end of the partition 21*c* in FIG. 3) is cut out, whereby a passing portion 41 is formed. Developer flows from the container 22 into the container 23 through the passing portion 41.

Figure 4C:
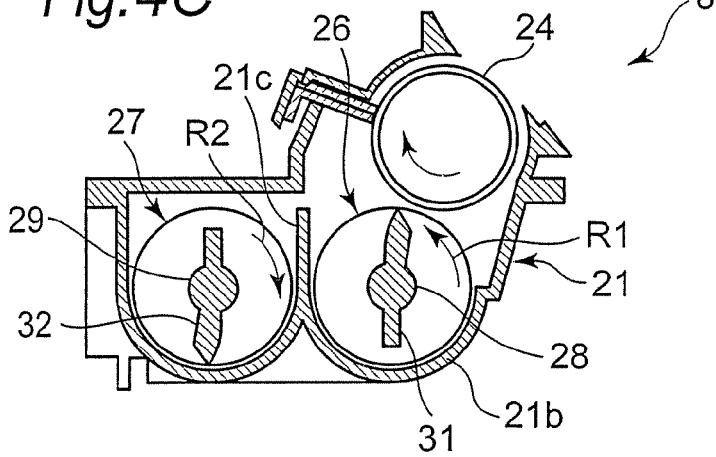
FIG. 4C is a cross-sectional view taken along line C-C of FIG. 3.
Figure 4D:
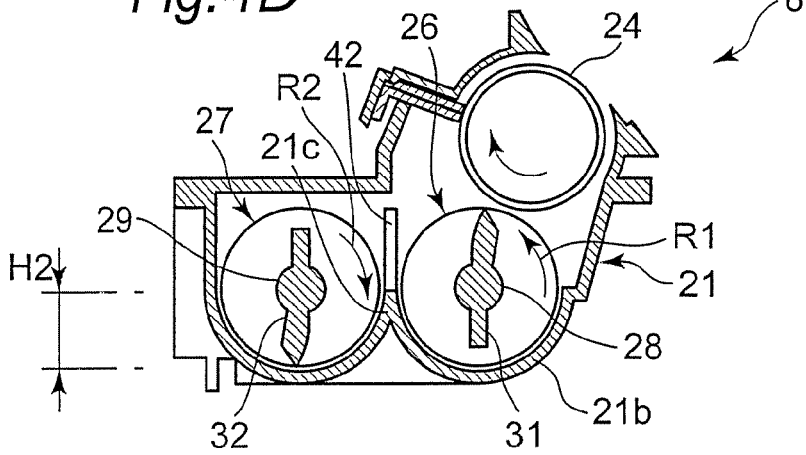
FIG. 4D is a cross-sectional view taken along line D-D of FIG. 3.

As shown in FIGS. 3, 4A, and 4D, to pass developer (an arrow B2) between a portion on the downstream side in the developer transport direction A2 of the developer transport member 27 and a portion on the upstream side in the developer transport direction A1 of the developer transport member 26, a portion of the partition 21*c* corresponding to these portions (near a left end of the partition 21*c* in FIG. 3) is cut out, whereby a passing portion 42 is formed. Developer flows from the container 23 into the container 22 through the passing portion 42.

As described above, since the developer discharging mechanism 34 is provided on the downstream side in the developer transport direction A1 of the developer transport member 26, the passing portion 41 is located at a location adjacent to the developer discharging mechanism 34 and the passing portion 42 is located at a location further away from the developer discharging mechanism 34 than the passing portion 41.

As shown in FIGS. 3, 4A, and 4C, the height of the partition 21*c* is set sufficiently high except for those portions corresponding to the passing portions 41 and 42, so that movement of developer does not occur between the developer transport member 26 (container 22) and the developer transport member 27 (container 23). In other words, passing of developer between the developer transport member 26 (container 22) and the developer transport member 27 (container 23) is limited only at the passing portions 41 and 42.

In the developer tank 21, as shown by the arrows A1, A2, B1, and B2 in FIG. 3, developer circulates in a path starting from the developer transport member 26 (container 22), passing through the passing portion 41, the developer transport member 27 (container 23), and the passing portion 42, and returning to the developer transport member 26. On the downstream side in the developer transport direction A1 of the developer transport member 26, a part of the developer is discharged by the developer discharging mechanism 34. Specifically, on the downstream side in the developer transport direction A1 of the developer transport member 26, a discharge force F300 (see FIG. 5B) attempting to plunge developer into the spiral blade 35 of the developer discharging mechanism 34 in the developer transport direction A1 and a blocking force F301 (oriented in the opposite direction to the direction of the discharge force F300) attempting by the spiral blade 35 to bring developer back to the developer transport member 26 act on the developer. Then, a portion of the developer that cannot be blocked by the blocking force F301 against the discharge force F300 crosses over the spiral blade 35 and reaches the developer discharge outlet 36 and is then discharged outside the developer tank 21. Developer is replenished in the developer tank 21 from the developer replenishing portion 37. By these operations, while developer in the developer tank 21 circulates in the developer tank 21 by the developer transport members 26 and 27, a small part of the developer is discharged outside the developer tank 21 through the developer discharge outlet 36 by the developer discharging mechanism 34 and the remaining most part circulates again in the developer tank 21.

The configurations of the passing portions 41 and 42 are set such that a transport force acting on developer at the passing portion 41 adjacent to the developer discharging mechanism 34 is greater than a transport force acing on developer at the passing portion 42 away from the developer discharging mechanism 34. Specifically, in the present embodiment, a height H1 of a lower end of the passing portion 41 is set lower than a height H2 of a lower end of the passing portion 42. The passing portions 41 and 42 have the same width W. The configurations of the passing portions 41 and 42 will be described in detail below.

Figure 5A:
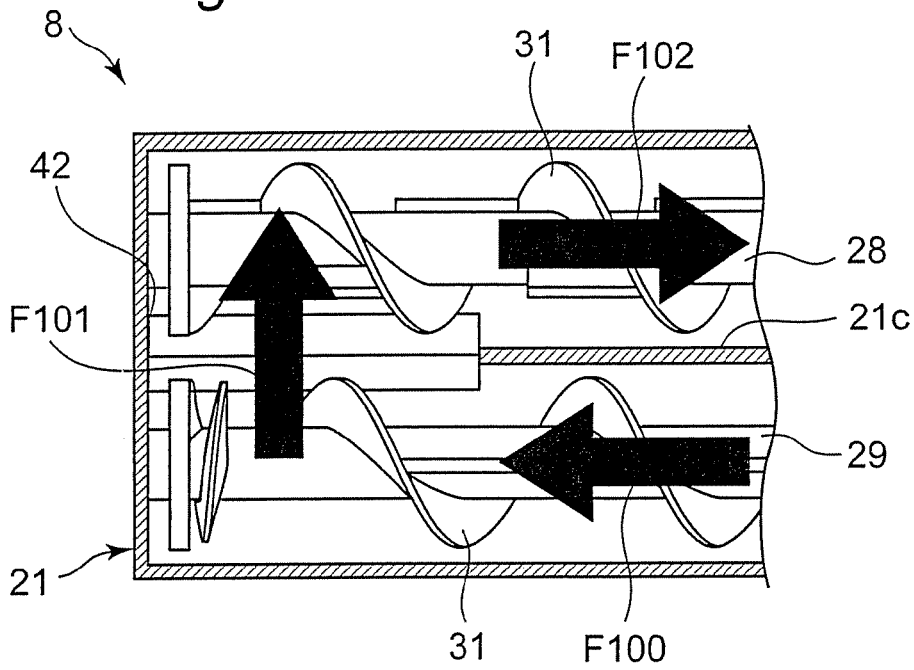
FIG. 5A is a partial enlarged cross-sectional view near one of passing portions in FIG. 3.

FIG. 5A is a diagram showing a force acting on developer near the passing portion 42 (the upstream side in the developer transport direction A1 of the developer transport member 26 and the downstream side in the developer transport direction A2 of the developer transport member 27). Developer is transported to the downstream side in the developer transport direction A2 by the developer transport member 27. A transport force acting on the developer at this time is referred to as F100. Then, the developer passes through the passing portion 42 and moves from the developer transport member 27 to the developer transport member 26. A transport force acting on the developer when passing through the passing portion 42 is referred to as F101. Thereafter, the developer is transported to the downstream side in the developer transport direction A1 by the developer transport member 26. A transport force acting on the developer at this time is referred to as F102. Since at the passing portion 42 the developer simply moves from the developer transport member 27 (container 23) to the developer transport member 26 (container 22), the transport force F101 needs to be proportional to the transport forces F100 and F102. That is, a relationship shown in the following equation (1) needs to be established among the transport forces F100 to F102:

$$F100=F101=F102 \quad (1).$$

Figure 5B:
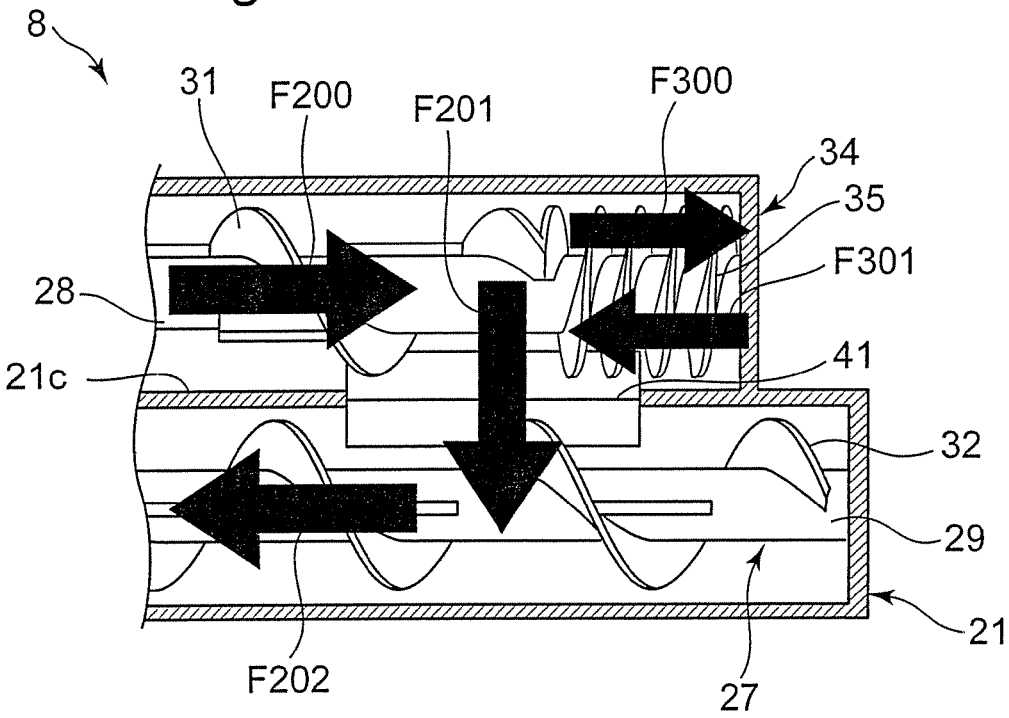
FIG. 5B is a partial enlarged cross-sectional view near the other passing portion in FIG. 3.

FIG. 5B is a diagram showing a force acting on developer at the passing portion 41 (the downstream side in the developer transport direction A1 of the developer transport member 26 and the upstream side in the developer transport direction A2 of the developer transport member 27). Developer is transported to the downstream side in the developer transport direction A1 by the developer transport member 26. A transport force acting on the developer at this time is referred to as F200. At an end on the downstream side of the developer transport member 26, as described above, a portion of the developer that cannot be blocked by the blocking force F301 against the discharge force F300 crosses over the spiral blade 35 of the developer discharging mechanism 34 and is discharged. Most part of the developer that is brought back by the blocking force F301 and thus is not discharged by the developer discharging mechanism 34 passes through the passing portion 41 and moves from the developer transport member 26 to the developer transport member 27. A transport force acting on the developer when passing through the passing portion 41 is referred to as F201. Thereafter, the developer is transported to the downstream side in the developer transport direction A2 by the developer transport member 27. A transport force acting on the developer at this time is referred to as F202.

The transport force F200 by the developer transport member 26 and the transport force F202 by the developer transport member 27 need to be proportional to each other. That is, a relationship shown in the following equation (2) needs to be established between the transport force F200 and the transport force F202:

$$F200=F202 \quad (2).$$

In order that a certain amount of developer can be discharged by the developer discharging mechanism 34, the discharge force F300 needs to be greater than the blocking force F301. That is, a relationship shown in the following equation (3) needs to be established between the discharge force F300 and the blocking force F301:

$$F300-F301>0 \quad (3).$$

The difference (F300–F301) between the discharge force F300 and the blocking force F301 shown on the left-hand side of equation (3) reduces the transport force F201 acting on the developer at the passing portion 41.

In order that the developer can smoothly circulate along the entire circulation path (the arrows A1, A2, B1, and B2) in the developer tank 21, all transport forces in the circulation path need to be proportional to one another. Taking into account equations (1) and (2) and the fact that, as described above, the difference between the discharge force F300 and the blocking force F301 reduces the transport force F201, in order that all transport forces in the circulation path can be proportional to one another, the following equation (4) needs to be established among the transport forces F100 to F102 and F200 to F202, the discharge force F300, and the blocking force F301:

$$F100=F101=F102=F200=F202=F201-(F300-F301) \quad (4).$$

By this equation (4), the transport force F201 at the passing portion 41 and the transport force F101 at the passing portion 42 need to satisfy a relationship shown in the following equation (5):

$$F101=F201-(F300-F301) \quad (5).$$

Since the relationship shown in equation (3) is established between the discharge force F300 and the blocking force F301, in order that transport forces in the entire circulation path (the arrows A1, A2, B1, and B2) in the developer tank 21 can be proportional to one another, as shown in the following equation (6), the transport force F201 at the passing portion 41 consequently needs to be greater than the transport force F101 at the passing portion 42.

$$F101<F201 \quad (6)$$

In the present embodiment, in order that the transport force F201 at the passing portion 41 can be greater than the transport force F101 at the passing portion 42, the height H1 of the lower end of the passing portion 41 is set lower than the height H2 of the lower end of the passing portion 42 so that developer can move more easily at the passing portion 41 than at the passing portion 42.

As described above, in the present embodiment, the height H1 of the lower end of the passing portion 41 is set lower than the height H2 of the lower end of the passing portion 42 to make the transport force F201 acting on developer at the passing portion 41 adjacent to the developer discharging mechanism 34 greater than the transport force F201 acting on developer at the passing portion 42 provided away from the developer discharging mechanism 34. This can eliminate or reduce the influence exerted on a developer transport force by the discharge force F300 and the blocking force F301 which act on developer in the developer discharging mechanism 34. As a result, the circulation performance of developer in the developer tank 21 is stabilized, enabling to stabilize the amount of developer in the developer tank 21 to a certain level. By suppressing an increase and decrease in the amount of developer in the developer tank 21, image loss or an insufficient supply of toner due to an insufficient amount of developer, or a local image overlap or an insufficient toner density resulting from a developer circulation failure due to an excess of developer can be eliminated or suppressed, enabling to achieve stable development performance.

Figure 6:
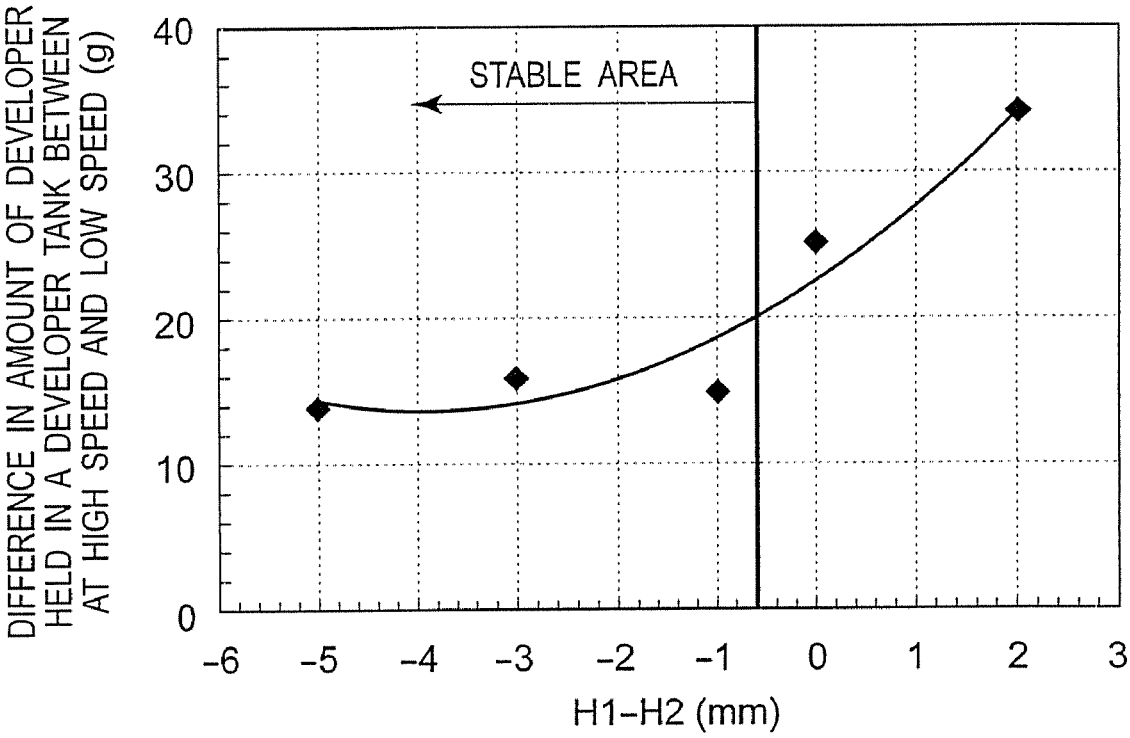
FIG. 6 is a graph showing a relationship of differences in the amounts of held developer caused by the speed among the heights of the passing portions.

FIG. 6 is a diagram showing results of an experiment carried out to examine a relationship between the heights H1 and H2 of the lower ends of the passing portions 41 and 42 and a change in the amount of developer held in the developer tank 21 associated with a change in the operating speed of the development apparatus 8. A horizontal axis in FIG. 6 represents a difference obtained by subtracting the height H2 of the lower end of the passing portion 42 from the height H1 of the lower end of the passing portion 41, and a vertical axis represents a difference in the amount of developer held in the developer tank 21 between when the operating speed of the development apparatus 8 is high and when low. It can be said that the smaller the value on the vertical axis, i.e., the difference in the amount of developer held in the developer tank 21 between at high speed and at low speed, the better the balance of circulation of developer in the developer tank 21.

From FIG. 6, when the height H1 of the passing portion 41 adjacent to the developer discharging mechanism 34 is higher than the height H2 of the passing portion 42 away from the developer discharging mechanism 34, the change in the amount of developer held in the developer tank 21 associated with a change in speed is great. That is, in this case, developer circulation in the developer tank 21 does not have a good balance. On the other hand, when the height H1 of the passing portion 41 adjacent to the developer discharging mechanism 34 is lower than the height H2 of the passing portion 42 away from the developer discharging mechanism 34, the change in the amount of developer held in the developer tank 21 associated with a change in speed is small. That is, in this case, developer circulation in the developer tank 21 has a good balance.

As described above, the fact that by setting the height H1 of the passing portion 41 adjacent to the developer discharging mechanism 34 lower than the height H2 of the passing portion 42 away from the developer discharging mechanism 34, developer circulation in the developer tank 21 obtains a good balance can be experimentally verified.

Second Embodiment

Figure 7:
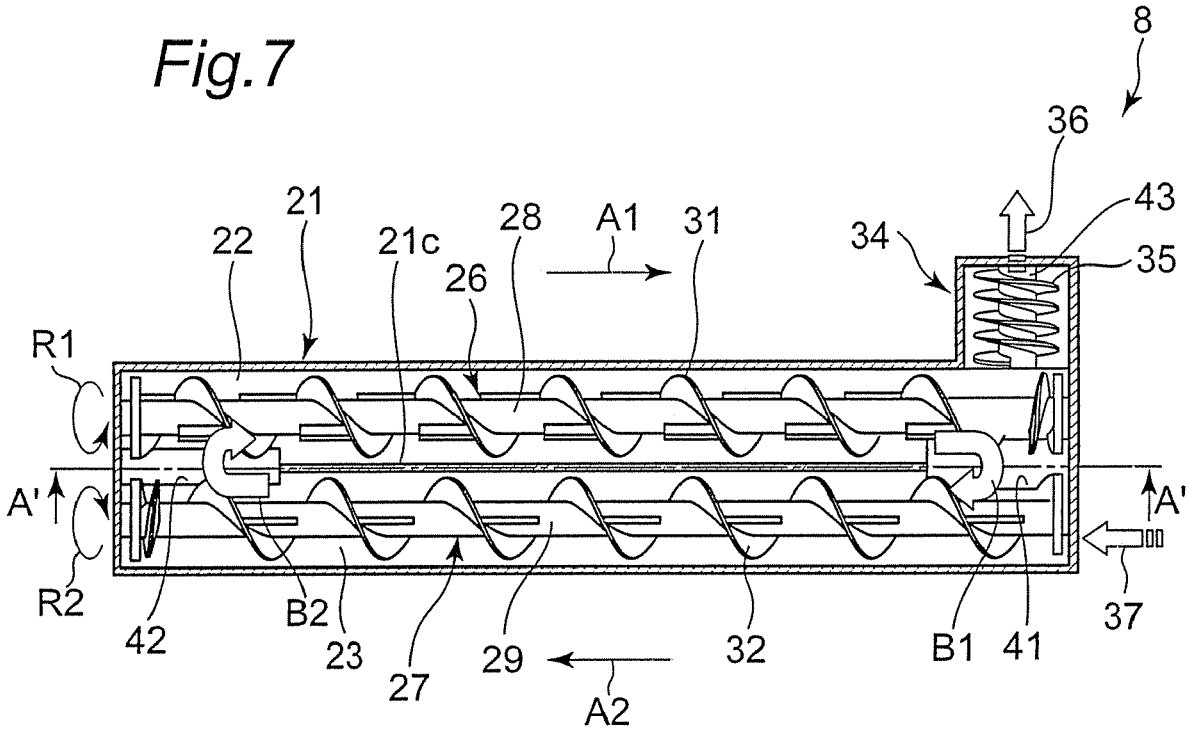
FIG. 7 is a schematic horizontal direction cross-sectional view showing a development apparatus according to a second embodiment of the present invention.
Figure 8:
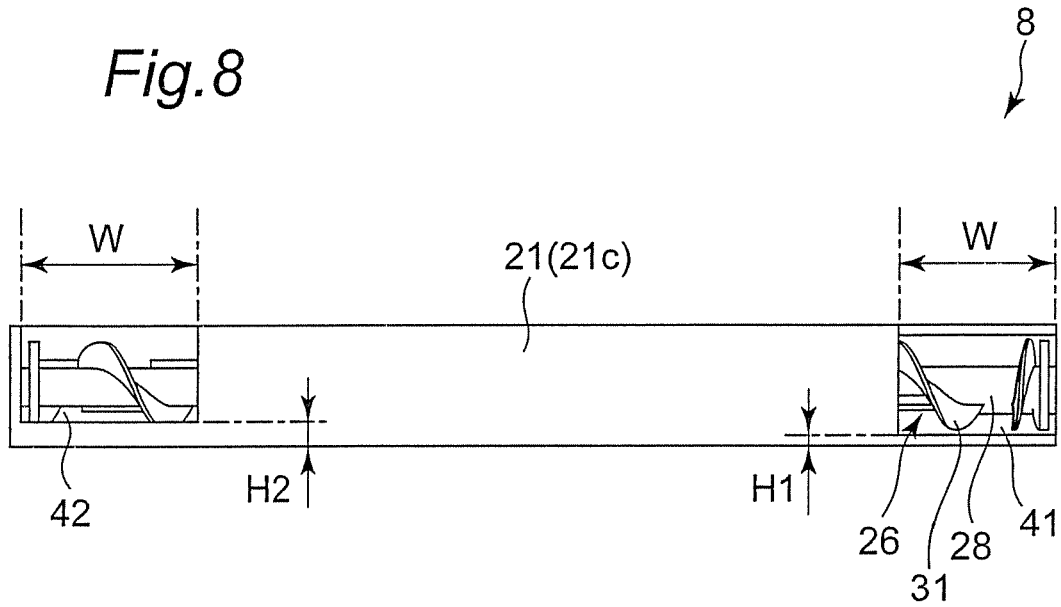
FIG. 8 is a cross-sectional view taken along line A'-A' of FIG. 7.

A development apparatus 8 according to a second embodiment of the present invention which is shown in FIGS. 7 and 8 is different from that according to the first embodiment in the structure of a developer discharging mechanism 34. Specifically, the developer discharging mechanism 34 according to the present embodiment includes a rotating shaft 43 extending in a direction orthogonal to a rotating shaft 28 of a developer transport member 26 and a spiral blade 35 is formed on the rotating shaft 43. That is, in the present embodiment, the developer discharging mechanism 34 causes developer to be discharged in the direction orthogonal to a developer transport direction A1 of the developer transport member 26. A height H1 of a lower end of a passing portion 41 adjacent to the developer discharging mechanism 34 is set lower than a height H2 of a lower end of a passing portion 42 provided away from the developer discharging mechanism 34, whereby the circulation performance of developer in a developer tank 21 can be stabilized, enabling to stabilize the amount of developer in the developer tank 21 to a certain level.

Other configurations and actions according to the second embodiment are the same as those according to the first embodiment.

Third Embodiment

Figure 9:
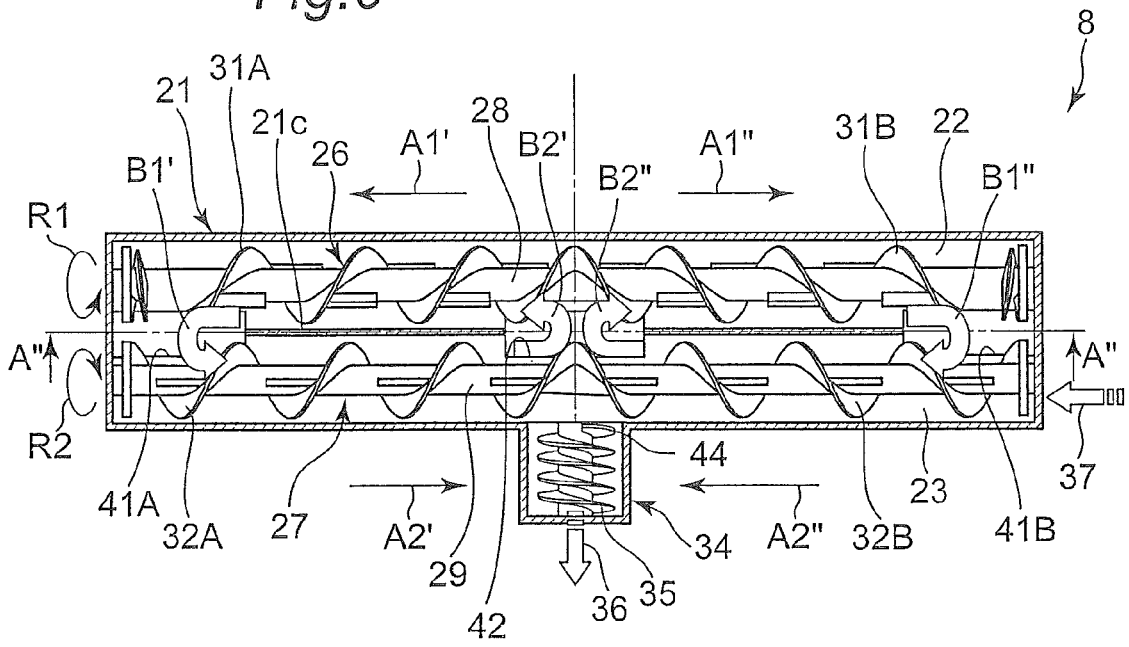
FIG. 9 is a schematic horizontal direction cross-sectional view showing a development apparatus according to a third embodiment of the present invention.
Figure 10:
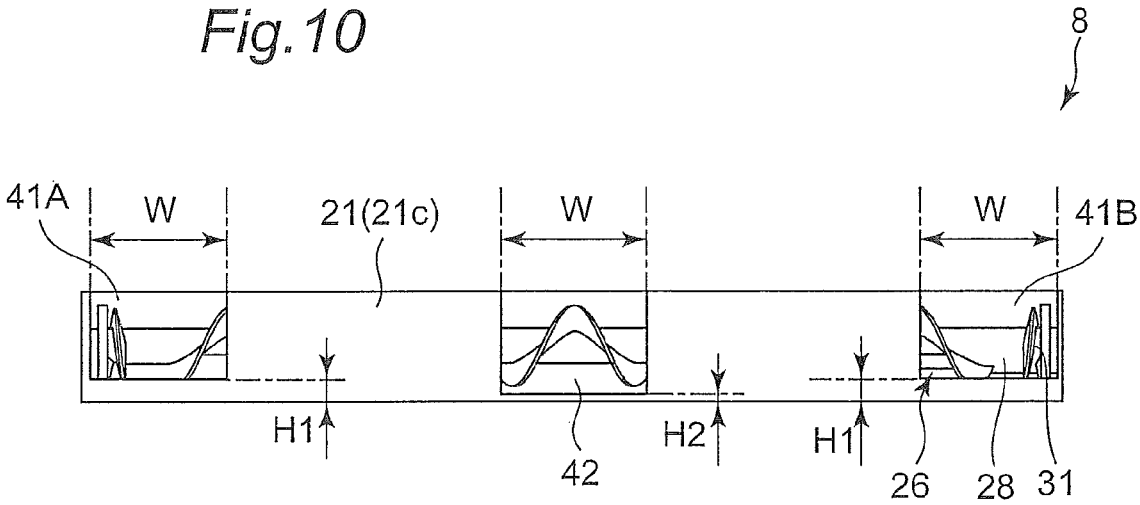
FIG. 10 is a cross-sectional view taken along line A"-A" of FIG. 9.

A development apparatus 8 according to a third embodiment of the present invention which is shown in FIGS. 9 and 10 is different from that according to the first embodiment in the mode of a developer circulation path in a developer tank 21.

A developer transport member 26 includes spiral blades 31A and 31B oriented in different directions and provided on the left and right sides in FIG. 9 from the center in a length direction of a rotating shaft 28. The spiral blades 31A and 31B are connected to each other on the center in the length direction of the rotating shaft 28. The developer transport member 26 transports developer from the center in the length direction to both ends. Specifically, while, as shown by an arrow A1', developer is transported by the spiral blade 31A from the center in the length direction to a left end in the drawing, as shown by an arrow A1", developer is transported by the spiral blade 31B from the center in the length direction to a right end in the drawing.

A developer transport member 27 also includes spiral blades 32A and 32B oriented in different directions and provided on the left and right sides in FIG. 9 from the center in a length direction of a rotating shaft 29. The spiral blades 32A and 32B are connected to each other on the center in the length direction of the rotating shaft 29. The developer transport member 27 transports developer from both ends in the length direction to the center. Specifically, while, as shown by an arrow A2', developer is transported by the spiral blade 32A from a left end in the drawing to the center, as shown by an arrow A2", developer is transported by the spiral blade 32B from a right end in the drawing to the center.

At portions of a partition 21*c* located at both ends of the developer transport members 26 and 27 are formed passing portions 41A and 41B that allow developer to flow from the developer transport member 26 (container 22) into the developer transport member 27 (container 23). Also, at a portion of the partition 21*c* located at the center in a longitudinal direction of the developer transport members 26 and 27 is formed a passing portion 42 that allows developer to flow (arrows B2' and B2") from the developer transport member 27 (container 23) into the developer transport member 26 (container 22).

A developer discharging mechanism 34 is provided adjacent to the passing portion 42. The developer discharging mechanism 34 includes a rotating shaft 44 that extends in a direction orthogonal to the rotating shafts 28 and 29 of the developer transport members 26 and 27 and that is rotatedly driven by a drive mechanism which is not shown; and a discharge spiral blade 35 formed on an outer surface of the rotating shaft 44.

Developer is transported from the center to both ends of the developer transport member 26 (the arrows A1' and A1"), flows into the developer transport member 27 through the passing portions 41A and 41B (arrows B1' and B1"), and is transported to the center of the developer transport member 27 (the arrows A2' and A2"). At the center of the developer transport member 27, a part of the developer is discharged outside the developer tank 21 by the developer discharging mechanism 34 and the remaining most part of the developer flows into the developer transport member 26 through the passing portion 42. The developer circulation path in the developer tank 21 forms substantially a figure-8 shape.

A height H2 of a lower end of the passing portion 42 adjacent to the developer discharging mechanism 34 is set lower than heights H1 of lower ends of the passing portions 41A and 41B provided away from the developer discharging mechanism 34. This can eliminate for reduce the influence exerted on a developer transport force by a discharge force F300 and a blocking force F301 (see FIG. 5B) which act on developer in the developer discharging mechanism 34. As a result, the circulation performance of developer in the developer tank 21 is stabilized, enabling to stabilize the amount of developer in the developer tank 21 to a certain level.

Other configurations and actions according to the third embodiment are the same as those according to the first embodiment.

Fourth Embodiment

Figure 11:
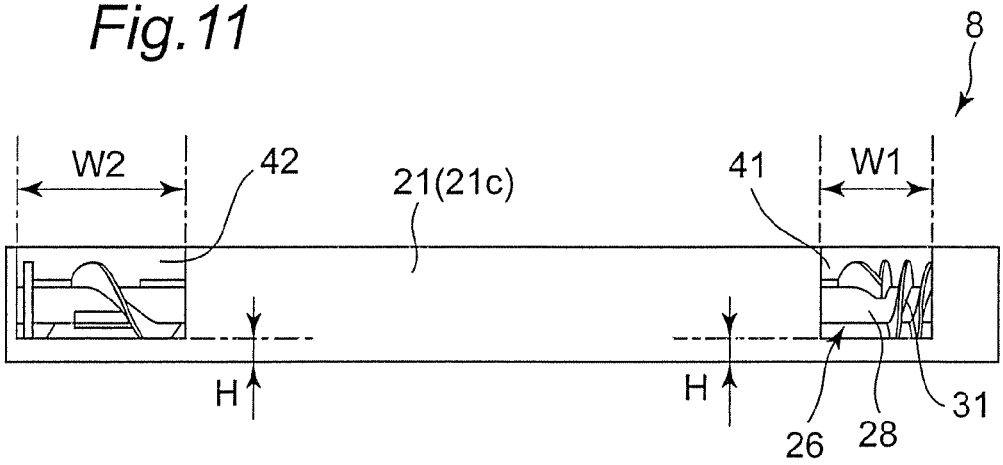
FIG. 11 is a schematic cross-sectional view showing a development apparatus according to a fourth embodiment of the present invention.

In the first embodiment, of the passing portions 41 and 42, the height Hi of the lower end of the passing portion 41 adjacent to the developer discharging mechanism 34 is set lower than the height H2 of the lower end of the passing portion 42 away from the developer discharging mechanism 34. On the other hand, in a development apparatus 8 according to a fourth embodiment of the present invention which is shown in FIG. 11, by making the widths of passing portions 41 and 42 different from each other, a transport force acting on developer at the passing portion 41 adjacent to a developer discharging mechanism 34 is made greater than a transport force acting on developer at the passing portion 42 away from the developer discharging mechanism 34. Note that lower ends of the passing portions 41 and 42 have the same height H.

Specifically, in the present embodiment, a width W1 of the passing portion 41 adjacent to the developer discharging mechanism 34 is set narrower than a width W2 of the passing portion 42 away from the developer discharging mechanism 34. By setting the widths W1 and W2 of the passing portions 41 and 42 in this manner, the flow speed of developer when passing through the passing portion 41 becomes higher than the flow speed of developer when passing through the passing portion 42, and accordingly, a developer transport force F201 (see FIG. 5B) at the passing portion 41 becomes relatively greater than a developer transport force F101 (see FIG. 5A) at the passing portion 42. As a result, the influence exerted on a developer transport force by a discharge force F300 and a blocking force F301 (see FIG. 5B) which act on developer in the developer discharging mechanism 34 can be eliminated or reduced and thus the circulation performance of developer in a developer tank 21 is stabilized, enabling to stabilize the amount of developer in the developer tank 21 to a certain level.

Other configurations and actions according to the fourth embodiment are the same as those according to the first embodiment.

Fifth Embodiment

Figure 12:
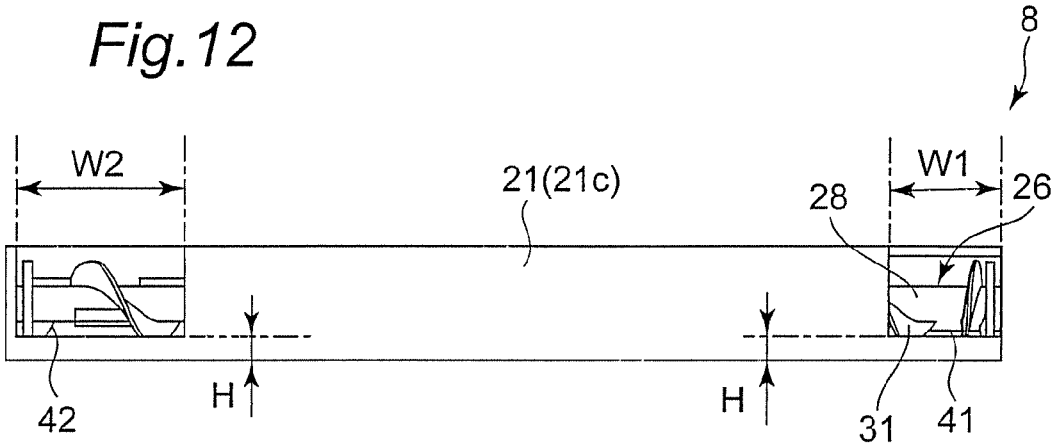
FIG. 12 is a schematic cross-sectional view showing a development apparatus according to a fifth embodiment of the present invention.

A development apparatus 8 according to a fifth embodiment of the present invention which is shown in FIG. 12 is such that in a development apparatus having the same structure as that according to the second embodiment (see FIGS. 7 and 8), a width W1 of a passing portion 41 adjacent to a developer discharging mechanism 34 is set narrower than a width W2 of a passing portion 42 away from the developer discharging mechanism 34 to make the flow speed of developer when passing through the passing portion 41 adjacent to the developer discharging mechanism 34 higher than the flow speed of developer when passing through the passing portion 42 away from the developer discharging mechanism 34. Note that heights H of lower ends of the passing portions 41 and 42 are the same.

Other configurations and actions according to the fifth embodiment are the same as those according to the second embodiment.

Sixth Embodiment

Figure 13:
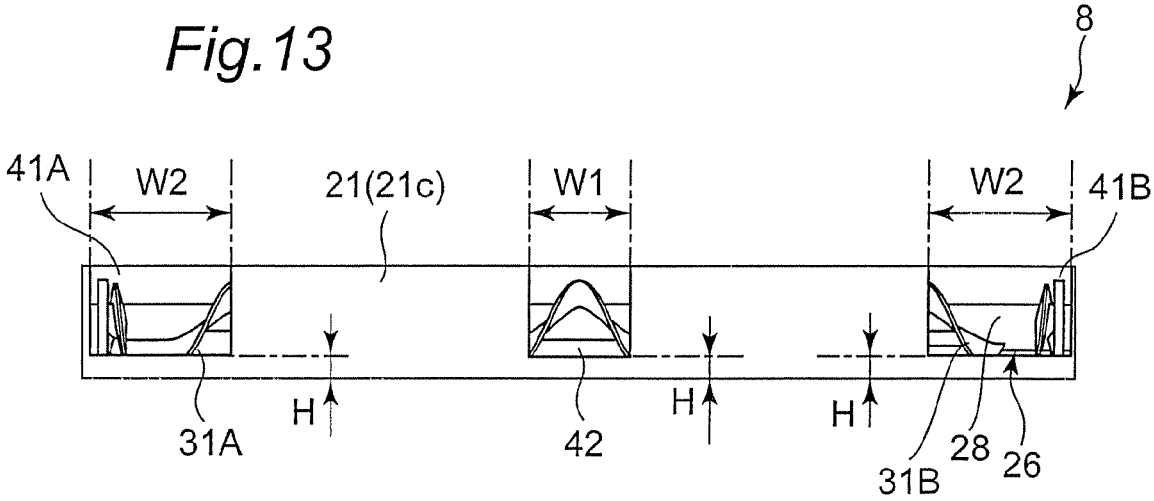
FIG. 13 is a schematic cross-sectional view showing a development apparatus according to a sixth embodiment of the present invention.

A development apparatus 8 according to a sixth embodiment of the present invention which is shown in FIG. 13 is such that in a development apparatus having the same structure as that according to the third embodiment (see FIGS. 8 and 9), a width W1 of a passing portion 42 adjacent to a developer discharging mechanism 34 is set narrower than widths W2 of passing portions 41A and 41B away from the developer discharging mechanism 34 to make the flow speed of developer when passing through the passing portion 42 adjacent to the developer discharging mechanism 34 higher than the flow speed of developer when passing through the passing portions 41A and 41B away from the developer discharging mechanism 34. Note that heights H of lower ends of the passing portions 41A, 41B, and 42 are the same.

Other configurations and actions according to the sixth embodiment are the same as those according to the third embodiment.

Although the present invention has been fully described in conjunction with preferred embodiments thereof with reference to the accompanying drawings, various changes and modifications are possible for those skilled in the art. Therefore, such changes and modifications should be construed as included in the present invention unless they depart from the intention and scope of the invention as defined by the appended claims.

What is claimed is:

1. A development apparatus comprising:

a developer tank that has first and second containers separated by a partition as to be adjacent to each other and respectively containing developer including toner and carrier;

a developer carrying member that carries the developer contained in the developer tank and allows the developer to be adhered onto an image carrying member;

a developer discharging mechanism that discharges a part of the developer contained in the developer tank;

a developer replenishing portion formed in the developer tank and replenishing an amount of developer that is proportional to an amount of the developer discharged by the developer discharging mechanism to the developer tank; and a first developer transport member and a second developer transport member that extend in an axial direction from one tank side wall to an opposing tank side wall and are respectively contained in the first and the second containers, the first and a second developer transport members transport the developer while stirring the developer and pass the developer to each other at a first passing portion and a second passing portion and thereby cause the developer to circulate in the developer tank, the first passing portion being formed at a location of the partition adjacent to the developer discharging mechanism and the second passing portion being formed at a location of the partition away from the developer discharging mechanism, wherein the first and the second passing portions have configurations in which a transport force acting on the developer at the first passing portion is greater than the transport force acting on the developer at the second passing portion; and the partition, from the area having the first passing portion, extends unobstructed to one of the tank side walls that is farthest from the second passing portion.

2. The development apparatus according to claim 1, wherein a width of the first passing portion is narrower than the width of the second passing portion.

3. The development apparatus according to claim 1, wherein the developer discharging mechanism is disposed on the developer tank at a midsection of the first and second developer transport members.

4. A development apparatus comprising:

a developer tank that has first and second containers separated by a partition so as to be adjacent to each other and respectively containing developer including toner and carrier;

a developer carrying member that carries the developer contained in the developer tank and allows the developer to be adhered onto an image carrying member;

a developer discharging mechanism that discharges a part of the developer contained in the developer tank;

a developer replenishing portion formed in the developer tank and replenishing an amount of developer that is proportional to an amount of the developer discharged by the developer discharging mechanism to the developer tank: and a first and a second developer transport members that are respectively contained in the first and the second containers and that transport the developer while stirring the developer and pass the developer to each other at a first passing portion and a second passing portion and thereby cause the developer to circulate in the developer tank, the first passing portion being formed at a location of the partition adjacent to the developer discharging mechanism and the second passing portion being formed at a location of the partition away from the developer discharging mechanism, wherein the first and the second passing portions have configurations in which a transport force acting on the developer at the first passing portion is greater than the transport force acting on the developer at the second passing portion; and wherein a height of a lower end of the first passing portion is lower than the height of a lower end of the second passing portion.

5. An image forming apparatus comprising a development apparatus, wherein the development apparatus comprises:

a developer tank that has first and second containers separated by a partition so as to be adjacent to each other and respectively containing developer including toner and carrier;

a developer carrying member that carries the developer contained in the developer tank and allows the developer to be adhered onto an image carrying member;

a developer discharging mechanism that discharges a part of the developer contained in the developer tank;

a developer replenishing portion formed in the developer tank and replenishing an amount of developer that is proportional to an amount of the developer discharged by the developer discharging mechanism to the developer tank; and a first developer transport member and a second developer transport member that extend in an axial direction from one tank side wall to an opposing tank side wall and are respectively contained in the first and the second containers, the first and a second developer transport members transport the developer while stirring the developer and pass the developer to each other at a first passing portion and a second passing portion and thereby cause the developer to circulate in the developer tank, the first passing portion being formed at a location of the partition adjacent to the developer discharging mechanism and the second passing portion being formed at a location of the partition away from the developer discharging mechanism, wherein the first and the second passing portions have configurations in which a transport force acting on the developer at the first passing portion is greater than the transport force acting on the developer at the second passing portion; and the partition, from the area having the first passing portion, extends unobstructed to one of the tank side walls that is farthest from the second passing portion.

6. The image forming apparatus according to claim 5, wherein a width of the first passing portion is narrower than the width of the second passing portion.

7. The image forming apparatus according to claim 5, wherein the developer discharging mechanism is disposed on the developer tank at a midsection of the first and second developer transport members.

8. A image forming apparatus comprising a development apparatus, wherein the development apparatus comprises:

a developer tank that has first and second containers separated by a partition so as to be adjacent to each other and respectively containing developer including toner and carrier;

a developer carrying member that carries the developer contained in the developer tank and allows the developer to be adhered onto an image carrying member;

a developer discharging mechanism that discharges a part of the developer contained in the developer tank;

a developer replenishing portion formed in the developer tank and replenishing an amount of developer that is proportional to an amount of the developer discharged by the developer discharging mechanism to the developer tank; and a first and a second developer transport members that are respectively contained in the first and the second containers and that transport the developer while stirring the developer and pass the developer to each other at a first passing portion and a second passing portion and thereby cause the developer to circulate in the developer tank, the first passing portion being formed at a location of the partition adjacent to the developer discharging mechanism and the second passing portion being formed at a location of the partition away from the developer discharging mechanism, wherein the first and the second passing portions have configurations in which a transport force acting on the developer at the first passing portion is greater than the transport force acting on the developer at the second passing portion; and wherein a height of a lower end of the first passing portion is lower than the height of a lower end of the second passing portion.

* * * * *